US008802218B2

(12) United States Patent
Li

(10) Patent No.: US 8,802,218 B2
(45) Date of Patent: Aug. 12, 2014

(54) CONSTRUCTION OF LOFT IN QUILTED MATERIALS

(76) Inventor: Yick Lap Li, Kowloon (HK)

( * ) Notice: Subject to any disclaimer, the term of this patent is extended or adjusted under 35 U.S.C. 154(b) by 166 days.

(21) Appl. No.: 13/332,930

(22) Filed: Dec. 21, 2011

(65) Prior Publication Data

US 2013/0164520 A1 Jun. 27, 2013

(51) Int. Cl.

| | |
|---|---|
| ***B32B 3/00*** | (2006.01) |
| ***B32B 7/00*** | (2006.01) |
| ***B32B 3/28*** | (2006.01) |
| ***B32B 5/14*** | (2006.01) |
| ***B32B 7/02*** | (2006.01) |
| ***A41B 13/06*** | (2006.01) |
| ***A47G 9/02*** | (2006.01) |
| ***B68G 7/00*** | (2006.01) |

(52) U.S. Cl.

USPC ..... 428/166; 428/119; 428/167; 428/171; 428/172; 428/213; 5/413 R; 29/91.1

(58) Field of Classification Search

USPC ..... 428/119, 156, 161, 162, 166, 167, 170, 428/171, 172, 173, 212, 213, 223, 920; 5/413 R; 29/91.1

See application file for complete search history.

(56) References Cited

U.S. PATENT DOCUMENTS

| | | | | |
|---|---|---|---|---|
| 4,092,750 | A * | 6/1978 | Ellis | 5/413 AM |
| 5,146,634 | A * | 9/1992 | Hunt | 5/486 |
| 5,274,846 | A * | 1/1994 | Kolsky | 428/178 |
| 5,798,166 | A * | 8/1998 | Gross | 428/166 |
| 6,610,382 | B1 * | 8/2003 | Kobe et al. | 428/119 |
| 2009/0155543 | A1 * | 6/2009 | Fowler | 428/179 |
| 2009/0202776 | A1 * | 8/2009 | Brandon et al. | 428/56 |
| 2010/0024125 | A1 * | 2/2010 | Li | 5/413 R |
| 2010/0086730 | A1 * | 4/2010 | Lo et al. | 428/116 |

* cited by examiner

*Primary Examiner* — Angela Ortiz
*Assistant Examiner* — Jeremy R Pierce
(74) *Attorney, Agent, or Firm* — Donald J. Ranft; Collen IP

(57) ABSTRACT

An insulating product utilizing pillars and arches to increase loft without increasing the thickness of the padding.

15 Claims, 4 Drawing Sheets

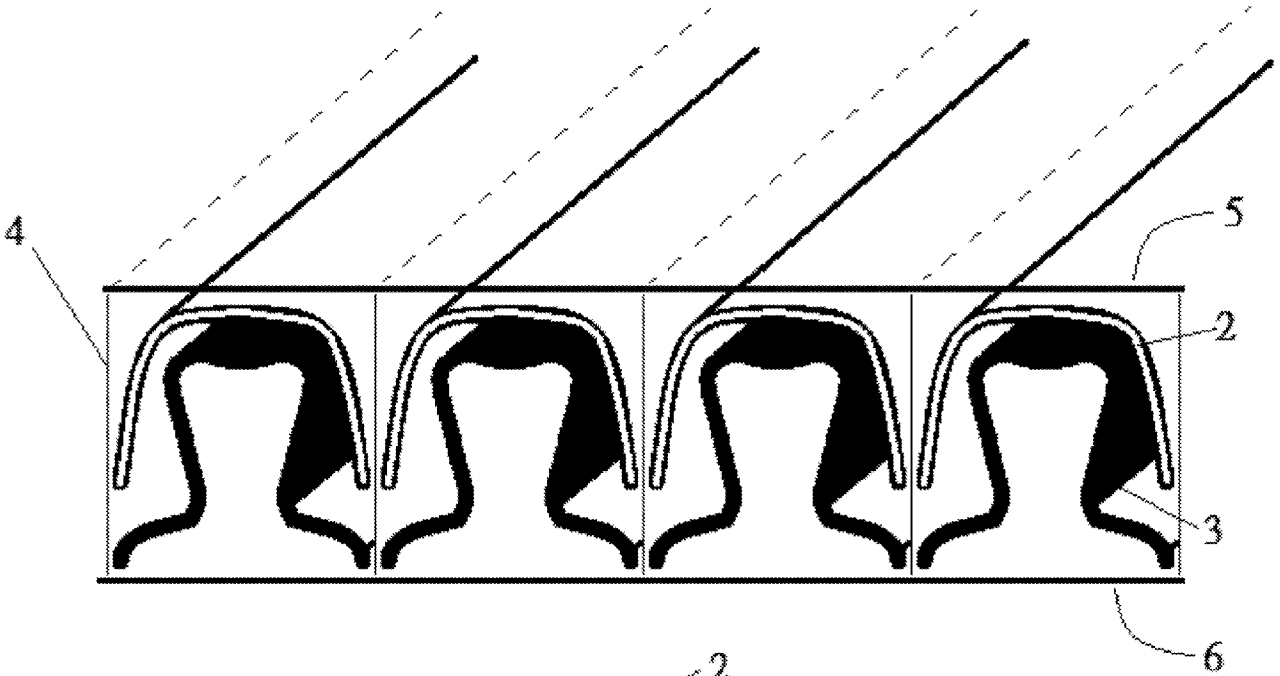
FIG. 2
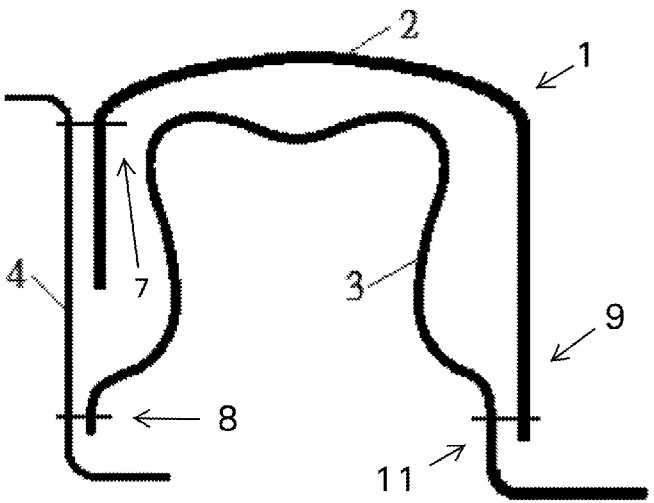

CONSTRUCTION OF LOFT IN QUILTED MATERIALS

BACKGROUND

Down feather and synthetic fiberfill are the two most commonly used materials one will find in any sleeping bag today. Each of these has their own pros and cons. Down is very warm and light weight but is also very expensive. In general, the thermal performance in a down product is directly proportional to the amount of down used (fill weight), so the construction in a down product is more to improve the user experience rather than to improve thermal efficiency. Synthetic fiberfill exists in the form of a padding which is made up of polyester fibers. Different proportions of the different fiber type results in various types of fiberfill padding available in the market today. Similar to down product, fiberfill product's performance is positively related to fill weight increase. However, there is a fundamental difference in construction between a down sleeping bag and a fiberfill sleeping bag.

Down behaves like a fluid, so the process of making a down sleeping bag is to create a compartment of space, and then fill it with the down material. The architecture/construction of the compartment, other than the necessary volume adjustment, is not a major determining factor to the overall thermal performance of the product. In a fiberfill sleeping bag, the fill weight adjustment is usually attained by putting together multiple layering of the fiberfill padding together in which the padding itself is also part of the overall product construction/structure. An effective construction technique plays a very important role in maximizing the overall thermal performance efficiency in a fiberfill sleeping bag.

There are various types of fiberfill construction: offset layering, shingle construction, anchored flexure system etc. Each of these has its respective benefits/shortcomings.

A common characteristic among all of the constructions above is that the quilting of the product (sleeping bag) always crosses horizontally (from side to side across a user's body—FIG. 1). Regardless of sizes, weight, constructions, brands, essentially all fiberfill sleeping bags are with horizontal quilting. The reasons for such setup are mostly due to better yield (consumption) and loft enhancement. Since the fiberfill padding is also part of the sleeping bag construction, the limiting factor is actually tied to the yield of fabric. Horizontal quilting/cuts give the best fabric yield in a sleeping bag and thus making it a natural fit in construction.

Loft is referring to how thick the layering is in a cross-section. The thicker the loft, the greater the distance separating the user from the outer environment which reduces the body heat escaping to the cold air outside. Loft is not only part of the specification in a sleeping bag, but also brings a very important visual appeal to the general consumer.

From a thermal performance perspective, horizontal quilting and loft are, however, somewhat mutually exclusive. Horizontal quilting requires the orientation of the fiberfill padding/cut to go from side to side. In such orientation, the loft expectation is the sum of the thickness of each padding layer. In simple math term, 1+1 will always be 2. An anchored flexure system enhances system loft by bending one of the padding layers. By taking advantage of the rebound of the fiberfill padding, an anchored flexure system is able to add an X factor to the loft (2+X). The down side to this is that the X factor can vary. Its effectiveness is determined by the type of fiberfill padding used, thus making the loft enhancement somewhat inconsistent.

The introduction of vertical quilting through the use of Vertical Inner Valve (U.S. Pat. No. 7,818,834 B2) has been very well received in the outdoor industry. Other than the visual enhancement, vertical quilting/baffling actually brings a very meaningful improvement to the user experience in a sleeping bag. It is very natural to think that the same technique can be applied to fiberfill synthetic sleeping bag as well. As established earlier, although both down-filled and synthetic fiberfill-filled share the same goal, the approach from manufacturing perspective is totally different from one another. If the goal is just to make the product look different, anyone can just simply turn any existing horizontal quilting into a vertical form by rotating it 90 degree. There is really no novelty to do this at all as the thermal performance is still limited by the nature (thickness) of the padding layer. So the challenge is how to improve the overall system performance in a vertically quilted sleeping bag. This forms the basis of the tubic construction.

BRIEF DESCRIPTION OF DRAWINGS

FIG. 2 depicts the tubic construction.

SUMMARY

The tubic construction provides a means to increase loft without increasing the thickness of the padding layer. This is especially significant for use in vertical quilting.

DETAILED DESCRIPTION

The concept of a tubic construction (1) is to break away from the traditional approach wherein fiberfill thickness equals system loft (thermal performance). The three main elements of this new design are: the arch (2), pillar (3) and bridge (4).

Figure 1:
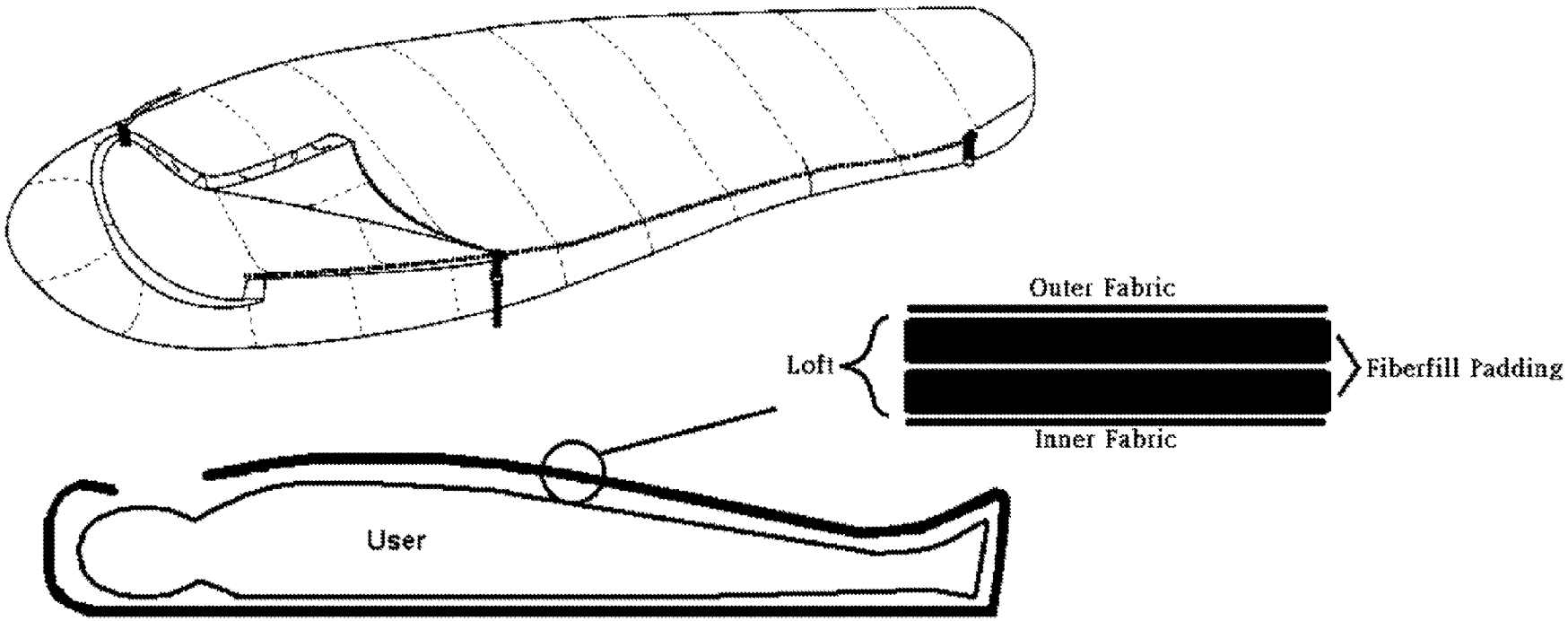
FIG. 1 depicts a typical existing sleeping bag with horizontal baffling.
Figure 3:
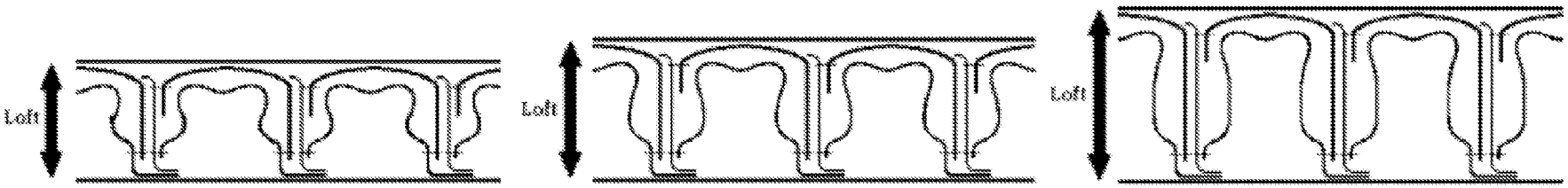
FIG. 3 depicts different heights using the tubic construction.
Figure 4:
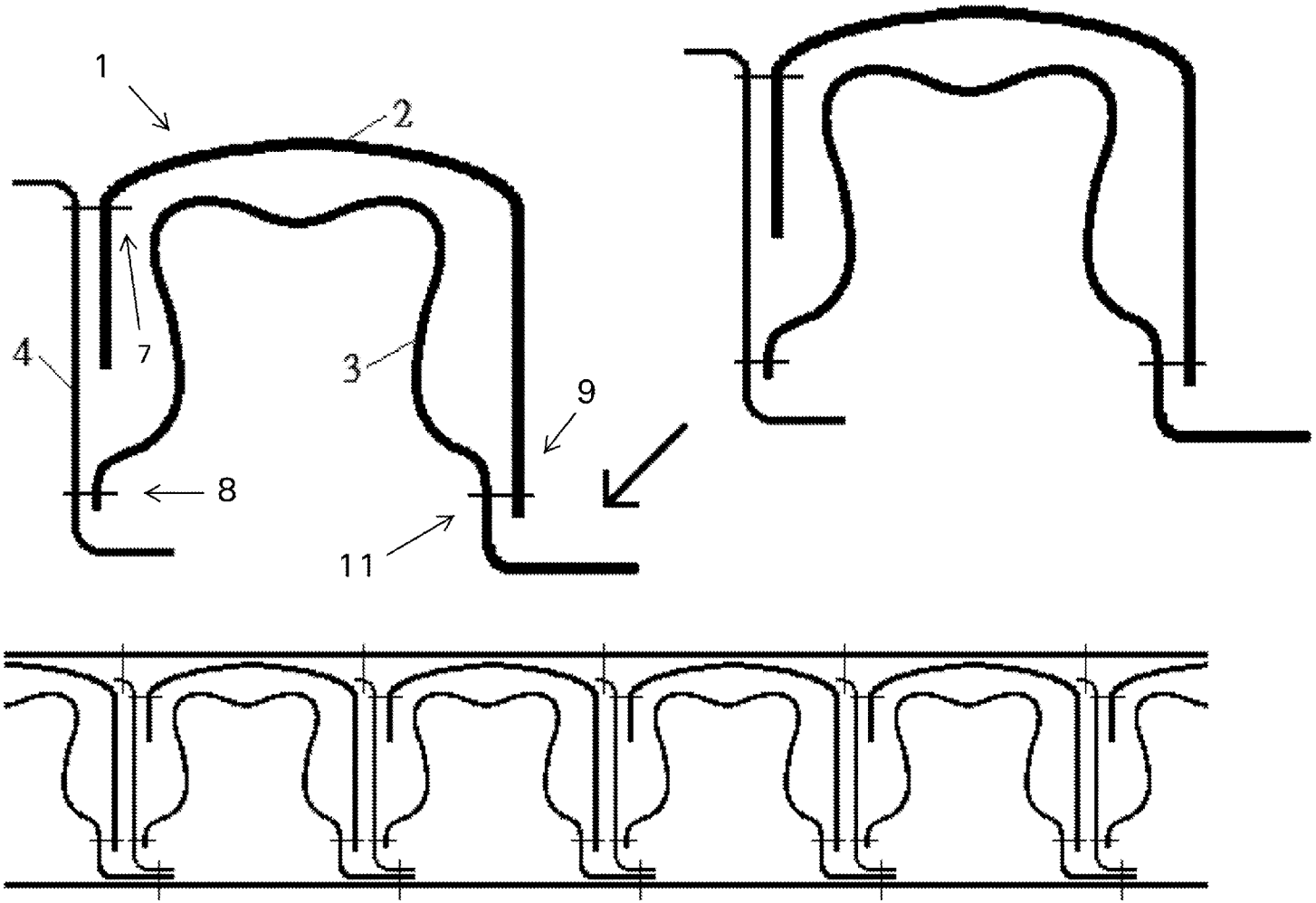
FIG. 4 depicts one embodiment for the tubic construction.

As shown on the figures, in a tubic construction (1), the arch (2) faces the outside whereas the pillar (3) stands up underneath the arch (2). As each of their names suggests, the arch (2) is like a rooftop in a house where the pillar (3) is serving as the foundation to support the structure. The bridge (4) forms the framework of the structure to which both the arch (2) and the pillar (3) are attached. Both the arch (2) and pillar (3) are typically essentially fiberfill padding cuts. The bridge (4) is just polyester mesh netting, a partition material commonly used in down sleeping bag construction. The height of the house (system loft) is determined by not just the thickness of each material, but it is also determined by how tall the pillar (3) is. As shown on FIG. 3, the height of the pillar (3) is configurable independent from its thickness. As a result, one can fully customize the system loft through adjusting the pillar (3) height.

Tubic Construction advantages are as below:

- Customizable loft. System loft is now totally configurable through adjusting the width of the pillar (3) piece, no longer bounded by the thickness of fiberfill padding.
- Weight control. By breaking the relationship between system loft and fiberfill padding thickness, one can build a sleeping bag using light weight but more thermal efficient padding. Through using lighter weight padding and adjusting the size of the pillar (3), one can have total control over the product weight.
- Better comfort. As established in Vertical Inner Valve (U.S. Pat. No. 7,818,834 B2), vertical quilting is actually tailoring to the human body much better and bringing better comfort to the end user.

The arch (2) and pillar (3) are each typically synthetic fiberfill padding of any kind. The arch (2) and pillar (3) can be the same padding or different padding. The bridge (4) can be of any fabric-like material, including a polyester mesh. The bridge (4) is connected to the outer shell fabric (5) on one end and to the inner shell fabric (6) on the other end. The opening end (7) of the arch (2) and the opening end (8) of the associated pillar (3) are connected to the same bridge (4) in at least one location. The finishing end (9) of the arch (2) is connected to the finishing end (11) of the pillar (3). The finishing end of the pillar (3) is connected to the adjacent bridge (4). The number and locations of all bridge, pillar and arch attachments can be varied as warranted.

The embodiment disclosed above comprises one arch (2) and 1 pillar (3) between adjacent bridges. Multiple deployments of arches (2) and pillars (3) are also possible in other embodiments. Additional configurations include 2 arch pieces+1 pillar piece, or 1 arch piece+2 pillar pieces . . . etc. In addition, the configuration of arches (2) and pillars (3) do not need to be consistent throughout the sleeping bag to provide more or less thermal protection in a particular area.

Although several embodiments described above and by the claims serve to illustrate various concepts, components and techniques which are the subject of this patent, it is apparent to those of ordinary skill in the art that other embodiments incorporating these concepts, components and techniques may be used. It is understood that the scope of the following claims are not limited to the described embodiments and that many modifications and embodiments are intended to be included within the scope of the following claims. In addition the specific terms utilized in the disclosure and claims are used in a generic and descriptive sense and not for the purpose of limiting the invention described in the following claims.

The invention claimed is:

1. An insulating product comprising:

an outer shell;

an inner shell;

a minimum of two bridges wherein each bridge has two ends with one end attached to the outer shell and a second end attached to the inner shell creating a baffle between each two adjacent bridges;

a minimum of two baffles;

a pillar with an opening end and a finishing end located in at least two baffles; and an arch with an opening end and a finishing end located above each pillar; wherein the opening end of the pillar and the opening end of the arch within the same baffle are attached to the same bridge and the finishing end of the arch is attached to the finishing end of the pillar.

2. An insulating product according to claim 1 in which the finishing end of the pillar is attached to the adjacent bridge.

3. An insulating product according to claim 1 further comprising multiple pillars within at least one baffle.

4. An insulating product according to claim 1 further comprising multiple arches within at least one baffle.

5. An insulating product according to claim 1 in which the height of the baffle, pillar and arch are different heights in different baffles as warranted providing better thermal performance in certain areas of the insulating product.

6. An insulating product according to claim 1 in which the insulating product is a sleeping bag.

7. An insulating product according to claim 1 in which the insulating product is clothing.

8. An insulating product according to claim 1 in which the baffles are parallel to each other.

9. An insulating product according to claim 1 in which the baffles are created vertically across the insulating product.

10. A method for creating an insulating product comprising:

creating an outer shell;

creating an inner shell;

attaching one side of the outer shell to one side of the inner shell;

attaching a minimum of two bridges wherein each bridge has two ends with one end attached to the outer shell and a second end attached to the inner shell creating a baffle between them;

creating a minimum of two baffles;

creating a pillar with an opening end and a finishing end;

creating an arch with an opening end and a finishing end located above the pillar;

attaching the opening end of the pillar and the opening end of the arch to the same bridge in the same baffle; and attaching the finishing end of the arch to the finishing end of the associated pillar in at least one location.

11. A method according to claim 10 in which the baffles are parallel to each other and arranged vertically across the insulating product.

12. A method according to claim 10 further comprising multiple pillars within at least one baffle.

13. A method according to claim 10 further comprising multiple arches within at least one baffle.

14. A method according to claim 10 in which the insulation product is clothes.

15. A method according to claim 10 in which the insulation product is a sleeping bag.

* * * * *